United States Patent [19]

Kozuka

[11] 4,204,644

[45] May 27, 1980

[54] SPRAYING APPARATUS FOR PREPARING GLASS FIBER REINFORCED CEMENTITIOUS PRODUCT

[75] Inventor: Mikio Kozuka, Yokohama, Japan

[73] Assignee: Asahi Glass Company, Limited, Tokyo, Japan

[21] Appl. No.: 844,918

[22] Filed: Oct. 25, 1977

[30] Foreign Application Priority Data

Nov. 18, 1976 [JP] Japan ..... 51-137794

[51] Int. Cl.[2] ..... B05B 7/24

[52] U.S. Cl. ..... 239/220; 118/308; 239/336; 239/418

[58] Field of Search ..... 239/219, 220, 221, 336, 239/418, 420; 118/309, 308, 324

[56] References Cited

U.S. PATENT DOCUMENTS

| | | | |
|---|---|---|---|
| Re. 20,660 | 2/1938 | Schacht | 118/308 |
| 1,588,062 | 6/1926 | Spivey | 239/220 |
| 1,667,291 | 4/1928 | Lavett | 239/220 |
| 3,061,150 | 10/1962 | Lindquist | 118/308 |
| 3,111,272 | 11/1963 | Underdown et al. | 239/420 |
| 3,659,790 | 5/1972 | Gelin | 239/336 |
| 3,960,108 | 6/1976 | Ichigo et al. | 118/324 |

FOREIGN PATENT DOCUMENTS

| | | | |
|---|---|---|---|
| 1360803 | 7/1974 | United Kingdom | 239/418 |

*Primary Examiner*—John J. Love

*Attorney, Agent, or Firm*—Oblon, Fisher, Spivak, McClelland & Maier

[57] ABSTRACT

A spraying apparatus for preparing a glass fiber reinforced cementitious product comprises a roll type cementitious mortar spray mechanism and a chopped strand spray mechanism which sprays a glass fiber chopped strand into the cementitious mortar stream sprayed by the roll type cementitious mortar spray mechanism.

12 Claims, 3 Drawing Figures

SPRAYING APPARATUS FOR PREPARING GLASS FIBER REINFORCED CEMENTITIOUS PRODUCT

BACKGROUND OF THE INVENTION

1. Field of the Invention

The present invention relates to a spraying apparatus for preparing a glass fiber reinforced cementitious product (hereinafter referring to as GRC).

2. Description of the Prior Arts

Recently, glass fibers having excellent alkali resistance have been developed whereby the GRC has been also developed. A premixing method, the direct-spraying method and the spray-sucking method have been employed in the industrial operation for preparing GRC. The sheeting method such as Hetcheck method and the extrusion molding method have be also studied as well as the above-mentioned industrial methods.

Among them, the former three methods have been found to be practical methods however, such are of the batch system type whereby the productivity is low and such are not suitable for mass production except for the production of the specific products.

In the Hatcheck method, the glass fiber is aligned in a specific direction and the strength thereof is lower in comparison with products prepared by the spraying method. Accordingly, the development of the spraying method which is suitable for the mass production has been considered to overcome such problems.

SUMMARY OF THE INVENTION

It is an object of the present invention to provide an improved spraying method of preparing a glass fiber reinforced cementitious product which is suitable for mass production.

The foregoing and other objects of the present invention have been attained by providing a spraying apparatus for preparing a glass fiber reinforced cementitious product which comprises a roll type cementitious mortar spray mechanism and a chopped strand spray mechanism which sprays a glass fiber chopped strand into a cementitious mortar stream sprayed by a roll type cementitious mortar spray mechanism.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
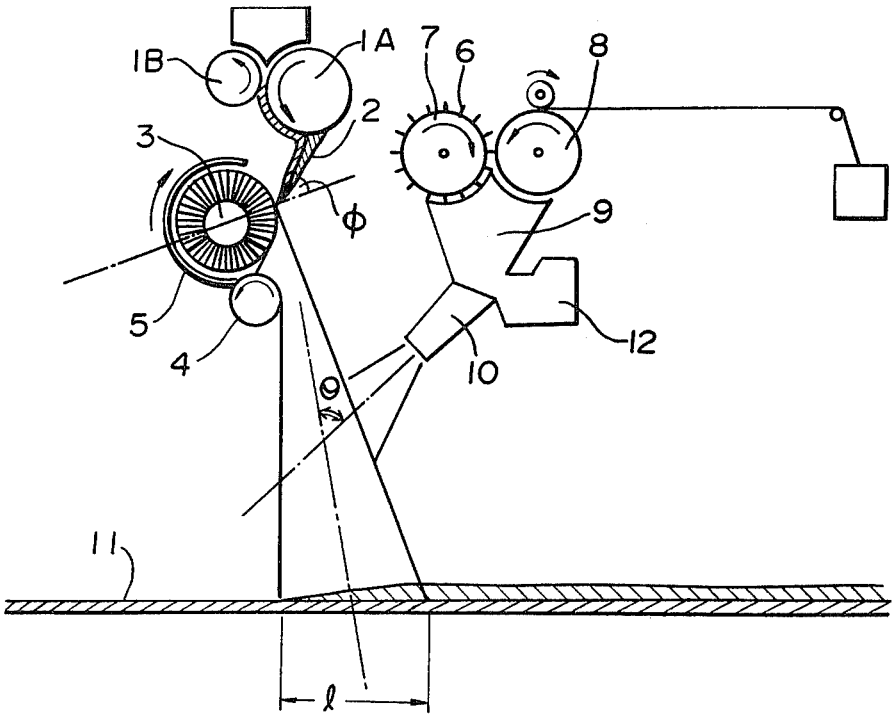
FIG. 1 is a side view of one embodiment of the spraying apparatus according to the present invention.

The principal feature of the present invention is to uniformly mix the glass fiber chopped strand with the cementitious mortar in the case of spraying a large volume of the materials, whereby the productivity is remarkably improved.

This feature is quite important. When a conventional gun type direct spraying apparatus or the spray-sucking apparatus is used for preparing a sheet, the gun is traversed in the transversal direction of the sheet and the gun or the corresponding table is gradually moved in the spraying operation. The sprayed volume of the materials per unit time has been found to be small whereby productivity is corresponding low. Moreover, precise control for the spraying operation has been required for uniformly spraying in both transversal and longitudinal directions.

In accordance with the apparatus of the present invention, it is unnecessary to traverse the gun in the transversal direction whereby the uniform spray in both of transversal and longitudinal directions can be easily attained and the volume of the sprayed material is correspondingly large. Accordingly, the velocity of the movement of the base, such as conventional frame, conveyor belt, etc., can be faster and the resulting productivity can be excellent.

In the present invention, the chopped strand is sprayed into cementitious mortar stream. The cementitious mortar stream formed by the roll type cementitious mortar spray mechanism is in a uniform spraying condition having substantially uniform width. The chopped strand, having a uniform distribution in a transverse direction, is sprayed by the chopped strand spray mechanism having the same width. As a result, a uniform mixing and uniform sprayed rate in a transverse direction can be attained.

Another feature of the apparatus of the present invention lies in the fact that such can be utilized for preparing various size products and can use a spray mechanism having a width of 300 mm to 3000 mm.

Drop falling of the cementitious mortar can be prevented and a desired sprayed pattern can be easily obtained by using a spray band adjusting roll together with the spray roll of the roll type cementitious mortar spray mechanism. The cementitious mortar cut by the spray band adjusting roll is reused for the spraying operation whereby spray loss is remarkably decreased. The effect is further increased by disposing a cover at the rear part of the spray roll.

The roll type cementitious mortar spray mechanism of the present serves to spray the cementitious mortar fed on the spray roll. If necessary a member, for cutting the cementitious mortar flow, such as a cover, is utilized.

The spray roll in the present invention can be made of a metal, a synthetic resin etc. a roll having concave and convex portions, a roll having a trough or a brush roll. When a roll which has concave and flexible convex portions is used, the advance or the contact to the spray band adjusting roll can be set as desired and the recovery of the cementitious mortar adhering to the spray band adjusting roll can be easily attained.

The feed of the cementitious mortar from the cementitious mortar feeder, especially a lip type feeder, can be smoothly attained so as to allow for uniform spray.

It is especially preferable to use a brush roll from the viewpoints of a desirable spray rate of the cementitious mortar, uniformity of the spray, and recovery of the cementitious mortar from the spray band adjusting roll and allowance for the approach or the contact to the spray band adjusting roll. The spray band adjusting roll is a roll having smooth surface made of metal, etc. and is preferably a roll having high wear resistance.

The cementitious mortar which is sprayed by using the spray band adjusting roll, adheres the surface of the spray band adjusting roll due to the tackiness of the cementitious mortar. The spray band adjusting roll is advanced to the spray roll and both rolls are reversely rotated with respect to each other so as to move adjacent surfaces thereof in the same direction whereby the cementitious mortar adheres to the surface of the spray roll. In another case, a cover is disposed at a rear part of the spray roll so as to contact one edge of the cover with the spray band adjusting roll and the cementitious mortar adhering to the spray band adjusting roll is scraped by the edge of the cover and is thus recovered. The cover is preferably disposed at a gap of less than 2 cm from the spray roll whereby the cementitious mortar is moved through a gap between the spray roll and the cover by rotation of the spray roll and the mortar can thus reused for spraying.

Since the roll type cementitious mortar spray mechanism is used, a large amount of the cementitious mortar is uniformly sprayed in a transverse direction with a low ratio of water to cement, if necessary. When this is combined with the glass fiber chopped strand spray mechanism, the glass fiber reinforced cementitious mortar can be uniformly sprayed in a transverse direction and the sheet of GRC can be easily prepared at a high velocity.

The cementitious mortars used in the present invention are compositions prepared by mixing water and a cement such as a hydraulic cement, e.g. Portland cement, alumina cement, magnesia cement, Roman cement, gypsum, lime or a mixture thereof, if necessary with an aggregate such as sand, stone, palite, vermiculite, foamed resin beads, etc.; with an additive such as a fly-ash, slug, terra alba, etc.; a fibrous reinforcing material such as asbestos, rock fiber, sluggish wool, glass fiber, synthetic fiber, natural fiber, metallic fiber etc.; a resin such as an epoxy emulsion, a rubber latex etc.; and other additives such as a water reducing agent, a retarder, a thickener, a waterproofing agent, a blowing agent, etc.

The glass fiber chopped strand spray mechanism in the present invention preferably includes a feed mechanism having a roll type chopped strand cutter and an air nozzle for spraying the cut chopped strand to the cementitious mortar stream with air nozzle being disposed below the cutter.

The spray mechanism which is used has a chopped strand cutter consisting of a cutter roll and a rubber roll; a chamber for falling the chopped strand, an air nozzle disposed at the bottom of the chamber for spraying the fallen chopped strand in a desired direction and a blowing duct having the air nozzle at the back thereof. The opening of the blowing duct at the end thereof, faces the cementitious mortar stream.

In operation, the cementitious mortar stream crosses the sprayed chopped strand flow at an angle of 10° to 90° preferably 30° to 80°, whereby the chopped strand is prevented from scattering out of a zone of operation and is uniformly mixed with the cementitious mortar such that change of the sprayed pattern of the cementitious mortar is substantially prevented.

When the chamber for distributing the chopped strands is in the form of a plurality of chambers having a width of 0.5 to 10 times to a length of the chopped strand, the chopped strand is uniformly advantageously distributed in transverse direction.

Referring to FIG. 1, an embodiment the apparatus of the present invention will now be discussed.

The spraying apparatus for preparing a glass fiber reinforced cement includes:

A cementitious mortar spray mechanism wherein the cementitious mortar is fed into a feeding lip (2) by cementitious mortar feed controlling rolls (1A), (1B) and is scattered by a spray roll (3) which rotates at high speed with a part of the scattered cementitious mortar being cut by the spray roll. A spray band adjusting roll (4) is also provided and is reversely rotated with the cementitious mortar being cut by a cover (5) whose edge is contacted with the spray band adjusting roll so as to transfer the cementitious mortar thus contacted for respraying.

The roll type chopped strand cutter comprises a cutter roll (7) having a plurality of cutter blades (6) on the peripheral part thereof and a rubber roll (8) contacted with the cutter roll (7). The chopped strand spray mechanism includes a plurality of chambers (9) divided in a transverse direction by partitions (not shown) which are disposed below the roll type chopped strand cutter, a blowing duct (10) which is disposed below the (9) chambers and slanted at an angle of about 45° to the table (11) so as to spray the chopped strand at an angle $\theta$ = about 50° to the center line of the cementitious mortar stream with an air nozzle and a compressed air feed member (12) at the rear part of the blowing duct.

The spray roll (3) can be selected depending upon the type and the amount of the cementitious mortar. The typical spray roll has an outer diameter of about 60 to 300 mm; a length of brush filament of about 15 to 140 mm and a diameter of brush filament of about 1 to 5 mm. The brush filament is made of a metal, a synthetic resin or a natural hair. The spray roll is usually rotated at about 200 to 2,000 rpm.

The typical spray band adjusting roll (4) has a diameter of about 50 to 300 mm and the peripheral speed of the roll is such as to prevent the scattering of the cementitious mortar by centrifugal force and is usually about 100 to 500 rpm. It is preferable to set the peripheral speed of the spray band adjusting roll to be slower than the peripheral speed of the brush roll, such as about 1/1.2 to 1/10 times of the peripheral speed of the brush roll.

The outer diameter and the revolutions per minute given are only examples and can be selected depending upon the type and amount of the cementitious mortar etc., as described.

The feeding lip (2) can be made of various materials such as metal, rubber etc. and preferably of wear resistant materials. The edge of the feed lip (2) is a knife edge and the feeding lip is preferably disposed so as to form acute angle to the tangential direction of the spray roll, that is, in FIG. 1 the angle $\phi$ is positive in a counterclockwise direction.

When the angle $\phi$ is negative; that is, the feeding lip is disposed below the line connecting the center of the spray roll and the point of approach of the spray roll to the feeding roll (vertical to the tangential line of the spray roll at the point of approach), such causes the cementitious mortar adhering to the feeding lip to drop.

When the spray roll (3) is contacted with the spray band adjusting roll (4), the cover (5) need not be contacted with the spray band adjusting roll and is disposed so as to recover the cementitious mortar sprayed from the contacted point. When the spray roll is not contacted with the spray band adjusting roll, the cover is disposed so as to contact with the spray band adjusting roll and is disposed so as to scrape the cementitious mortar on the spray band adjusting roll, whereby the cementitious mortar is recovered.

In such case, the cover (5) is disposed between a position contacting with the spray band adjusting roll and a position in front of the cementitious mortar feeding means with a gap of less than 2 cm, preferably about 2 to 5 mm, from the peripheral part of the spray roll, whereby the cementitious mortar held between the cover and the spray roll is transferred by the rotary force of the spray roll and the cementitious mortar is easily resprayed.

The sprayed pattern on the table can be selected by controlling the position of the spray band adjusting roll (4). In particularly, the length l in FIG. 1 can be controlled as desired whereby the amount of the cementitious mortar on the table can thus be adjusted as desired.

Figure 2:
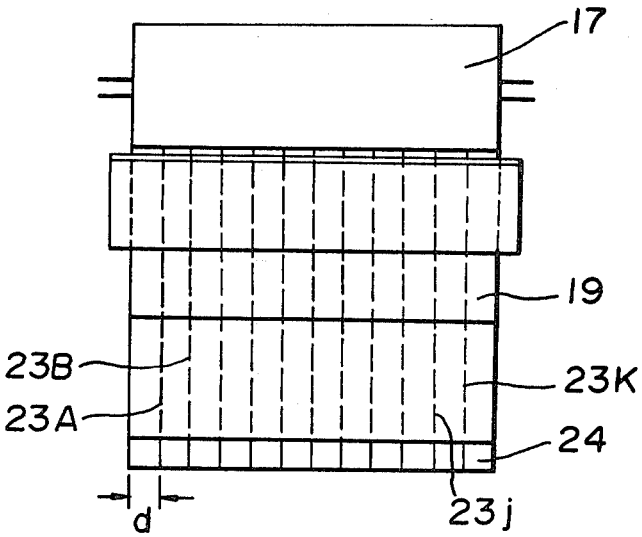
FIG. 2 is a front view of one embodiment of a chopped strand spray mechanism used in the present invention.

FIG. 2 is a front view of the chopped strand spray mechanism of FIG. 1. In FIG. 2, the rubber roll is disposed at the rear part of a cutter roll (17) with a plurality of chambers (19) divided by partitions (23A)-(23K) with the constant space being disposed below both of the rolls. The blowing duct below the chambers is forwardly slanted to form the opening part (24). In FIG. 2, the air nozzle is disposed at the rear part thereof.

Figure 3:
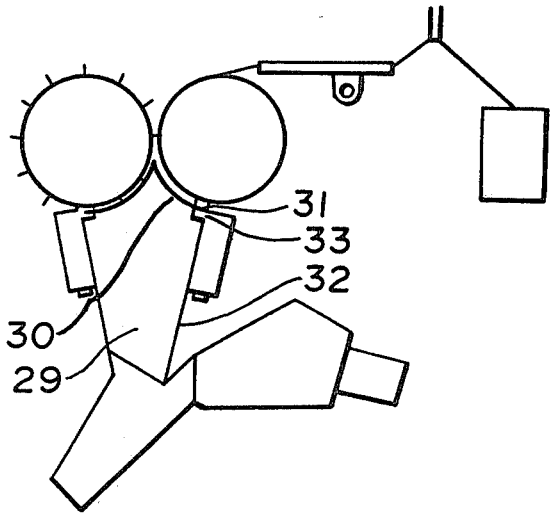
FIG. 3 is a side view of one embodiment the chopped strand spray mechanism used in the present invention.

FIG. 3 is a side view of a preferable embodiment of the chopped strand spray mechanism wherein an air nozzle (31) for forming the air stream along the upper part (30) of the partition is disposed above the chamber (29) below the cutter and an air nozzle (33) for forming the downwardly directed air stream along the inside face of walls is disposed on the wall (32) of the chamber, thereby preventing adhesion of the chopped strand on the upper parts and walls of the partitions.

The chopped strand spray mechanism in the present invention is used to spray the chopped strands to the cementitious mortar stream. When the cross angle $\theta$ between the cementitious mortar stream and the chopped strand stream is in a range of 10° to 90° especially 30° to 80°, a mixed spray can be attained as desired. The roll type cementitious mortar spray mechanism uniformly sprays the cementitious mortar in a transverse direction whereby the chopped strand can be easily and uniformly mixed in such transverse direction. In comparison with the conventional gun type spraying apparatus for preparing GRC, the uniform mixing and the uniform amount of the sprayed materials in a transverse direction can be easily attained. In the chopped strand spray mechanism, it is preferable to dispose the chambers below the chopped strand cutter and to divide the chambers with the partitions discussed hereinabove.

The roving thus formed is preferably cut to a length of chopped strand of about 10 to 100 mm. In this case, the width of the divided chamber is preferably at a ratio about 0.5 to 10 times of the length of the chopped strand. When such is less than 0.5 times, clogging is easily caused in the chamber and an alignment of the chopped strand is easily caused. When such is more than 10 times, uniform dispersion is substantially reduced. When such is in a range of about 1 to 3 times, an optimum effect can be obtained. When the chopped strand having a length of 20 to 50 mm and the width of the divided chamber is about 1.2 to 2 times of the length of the chopped strand, the amount of the sprayed materials per unit area is remarkably uniform.

The roll type chopped strand cutter preferably consists of the cutter roll and a pressure roll such as the rubber roll. The length of the cutter is preferably about 200 to 3000 mm. It is also preferable to utilize about 5 to 60 of the divided chambers having the desired width depending upon the length of the chopped strand.

When the number of the divided chambers is less than or equal 4, the distribution is not satisfactory to impart the effect desired. It is preferable to dispose more than 10 of the divided chambers except in a small size apparatus from the viewpoint of the uniform distribution.

It is also preferable to dispose the air nozzle for forming the air stream along the inside face of wall of the divided chambers to prevent hanging of the cut chopped strand on the wall and to dispose the air nozzle for forming the air stream along the upper part of the partitions to prevent the clogging caused by the cut chopped strand put on the partitions or to prevent the adverse effect to the cutter. The cause for ununiform distribution of the chopped strand around the cutter can be eliminated by disposing the two kinds of the air nozzles.

The divided chambers can be opened at the bottoms thereof so as to drop the chopped strand. When further uniform distribution of the chopped strand is desired, it is preferable to dispose the air nozzle for blowing off the strands. It is especially desirable to dispose the air nozzle at the rear part of the blowing duct connected to the slanted lower parts of the chambers such that fallen chopped strands are blown out in a slanted direction. In this case, it is preferable to dispose the blowing duct so as to provide an angle of 20° to 70° to the direction of travel of the falling chopped strands from the cutter from the viewpoint of uniform spray of the chopped strands, retention chopped strands around the air nozzle and prevention of formation of masses of chopped strands.

The table (11) can be a conventional frame or conveyor belt. The GRC can be continuously prepared by relative movement of the table (11) with respect to the spraying apparatus for preparing the GRC.

It is also possible to combine the table (11) with a suction for dewatering, pressing, and a smoothing operation and coating, etc. The present invention will be further illustrated by the following example. In the example, the cementitious mortar spray mechanism shown in FIG. 1 and the chopped strand spray mechanism shown in FIG. 3 are combined. In particularly, a spray roll having a length of 1150 mm, an outer diameter of 160 mm and polypropylene monofilaments having triangular section having a side of 2.5 mm and a length of 30 mm and a density of 4 filaments per $cm^2$ were disposed at the position 500 mm from the table and rotated at 1400 rpm. A spray band adjusting roll having an outer diameter of 100 mm, made of a mild steel was disposed with a gap of about 1 mm from the spray roll, including a spray length l of 200 mm, and was reversely rotated at 300 rpm. A cover was disposed over the spray roll with a gap of 3 mm from position of contact with the spray band adjusting roll in front of the cementitious mortar feeding lip. Cementitious mortar consisting of 66 wt. % of Portland cement, 33 wt. % of sand and 1 wt. % of a water reducing agent at a ratio of water to cement of 35 wt. % was fed through the feeding lip made of rubber at a rate of 100 kg/min. and sprayed.

The chopped strand spray mechanism included a cutter roll having a length of 1100 mm, a diameter of 200 mm and 18 blades with a corresponding rubber roll. The roving (Cem FIL ®) supplied were cut to a length of 35 mm. The chambers divided by partitions separated by a distance of 50 mm were disposed below the rolls. A blowing duct was slanted at an angle of 45° and an air nozzle was disposed at the rear part of the duct with the chopped strand being blown under the pressure of 200 mm $H_2O$ at a rate of 3.2 kg/min.

Air nozzles were disposed for forming air streams along the upper parts and walls of the partitions at the upper parts of the divided chambers so as to prevent adhesion of the chopped strand on the walls of the chambers, thereby preventing the nonuniform distribution of the chopped strand caused by the clogging of the chambers.

The table (11) was moved at a rate of 9 m/min. while spraying both of the cementitious mortar and the chopped strands to obtain a green sheet of the GRC having a thickness of about 5 mm. The green sheet was then dewatered under suction and was cured in air at room temperature for 28 days.

The resulting sheet of GRC had the bending strength of 408 kg/cm$^2$ in the longitudinal direction thereof and 265 kg/cm$^2$ in the transverse direction thereof with an impact strength (Izod type tester) of 12.3 kgcm/cm$^2$ in the longitudinal direction and 8 kgcm/cm$^2$ in the transversal direction as well as a specific gravity of 2.2 g/cm$^3$. Variation of the strength in the transverse direction was not substantially found. A uniform sheet of GRC could be obtained with high productivity and loss of cementitious mortar and chopped strands were not substantially found. In the spraying apparatus for preparing GRC of the present invention, a large amount of the composition of the cementitious mortar and the chopped strands can be sprayed and the uniformity of the sheet of GRC in a transverse direction can be easily attained in comparison with a conventional gun type spraying apparatus for preparing GRC. Various applications can thus be attained in the preparation of the sheets of GRC. When the continuous spray-suction method is employed by using the apparatus of the present invention, a GRC having high strength can be therefore prepared in mass production.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A spraying apparatus for preparing a glass fiber reinforced cementitious product comprising:

a roll type cementitious mortar spray means adapted to discharge a transverse sheet of cementitious material; and a chopped strand spray means adapted to discharge a transverse sheet of chopped strands, including a passage member through which chopped strands fall in a first direction and a second passage forming an angle of 20° to 70° with said first passage, having an elongated outlet of substantially the same width as said roll type spray means which sprays a glass fiber chopped strand along a first axis by air flow into a cementitious mortar flow sprayed along a second axis by the roll type spray means such that a cross angle formed between said first axis and said second axis is 30° to 80° wherein the chopped strand spray means comprises a roll type chopped strand cutter and a first air nozzle disposed within said second passage so as to spray the cut chopped strand, the width of the cutter being substantially the same as the width of the sprayed chopped strand.

2. A spraying apparatus according to claim 1, wherein the chopped strand spray means further comprises a chopped strand feeding means having a broad width cylindrical chamber having an opening at an upper end portion thereof and a second air nozzle for forming a down air stream along the inside face of the wall of the chamber and said chamber being disposed below the cutter.

3. A spraying apparatus according to claim 2 wherein the chamber for the chopped strand feed means is divided into a plurality of chambers each having width of 0.5 to 10 times of a length of the chopped strand.

4. A spraying apparatus according to claim 1 wherein the roll type spray means includes concave and convex surfaces with the convex surfaces being flexible and further comprising cementitious mortar feed means for feeding the cementitious mortar on the roll type spray means.

5. A spraying apparatus according to claim 4 wherein the spray roll is a brush roll.

6. A spraying apparatus according to claim 4 wherein the cementitious mortar feeding means comprises a feeding lip disposed adjacent to the roll type spray means for scraping the cementitious mortar on the feeding lip by the roll type spray means.

7. A spraying apparatus according to claim 1 wherein a cover is disposed at the rear part of the roll type spray means.

8. A spraying apparatus according to claim 7 wherein one edge of the cover is contacted with the spray band adjusting roll and the other edge of the cover is extended in front of the cementitious mortar feed means.

9. A spraying apparatus according to claim 1 wherein said first air nozzle is disposed below said cutter and the width of said sprayed chopped strand corresponds to the width of the flowing cementitious mortar.

10. A spraying apparatus for preparing a glass fiber reinforced cementitious product comprising:

a roll type cementitious mortar spray means; and a chopped strand spray means, including a passage member through which chopped strands fall in a first direction and a second passage forming an angle of 20° to 70° with said first passage, having substantially the same width as said roll type spray means which sprays a glass fiber chopped strand along a first axis by air flow into the cementitious mortar flow sprayed along a second axis by the roll type spray means such that a cross angle formed between said first axis and said second axis is 30° to 80° wherein the chopped strand spray means comprises a roll type chopped strand cutter and a first air nozzle disposed within said second passage so as to spray the cut chopped strand, the width of the cutter being substantially the same as the width of the sprayed chopped strand wherein the roll type spray means includes a spray band adjusting roll which is disposed adjacent to the roll type spray means and is reversely rotated with respect to the spray roll.

11. A spraying apparatus according to claim 10 said cementitious mortar feeding means further comprising a feeding lip disposed adjacent to the spray band adjusting roll so as to scrape the cementitious mortar on the spray band adjusting roll and at least one cementitious mortar feding roll operably associated with said feeding lip.

12. A spraying apparatus according to claim 10 wherein said spray band adjusting roll has a diameter of 50–300 mm.

* * * * *